United States Patent [19]

Gancia et al.

[11] Patent Number: 4,478,065

[45] Date of Patent: Oct. 23, 1984

[54] CONTINUOUS ROLLING MILL WITH CROSSED STANDS FOR THE PRODUCTION OF SEAMLESS TUBES

[75] Inventors: Emanuele Gancia, Pioltello; Cesare Galletti, S. Felice di Segrate, both of Italy

[73] Assignee: Innse Innocenti Santeustacchio S.p.A., Brescia, Italy

[21] Appl. No.: 387,256

[22] Filed: Jun. 10, 1982

[30] Foreign Application Priority Data

Jun. 11, 1981 [IT] Italy ..... 22255 A/81

[51] Int. Cl.[3] ..... B21B 31/08

[52] U.S. Cl. ..... 72/239

[58] Field of Search ..... 72/235, 238, 239, 481, 72/482, 446, 448; 100/918

[56] References Cited

U.S. PATENT DOCUMENTS 4,406,145 9/1983 Akita ..... 72/239

FOREIGN PATENT DOCUMENTS 53-60861 5/1978 Japan ..... 72/238

*Primary Examiner*—E. Michael Combs
*Assistant Examiner*—Charles Rosenberg
*Attorney, Agent, or Firm*—Fleit, Jacobson, Cohn & Price

[57] ABSTRACT

A continuous rolling mill with crossed alternately inclined stands is described in which the working rolls and their roll chocks forming each stand are united to form a unit which can be displaced individually in a direction parallel to the axes of rotation of the said rolls. During changing of the rolls, a thrust member expels the said unit from the stand, in a direction parallel to the axes of rotation of the rolls, onto a load-carrying platform which can be tipped about an axis parallel to the rolling direction to a horizontal position on a carriage which is movable on rails along the sides of the rolling mill.

7 Claims, 4 Drawing Figures

FIG. 3
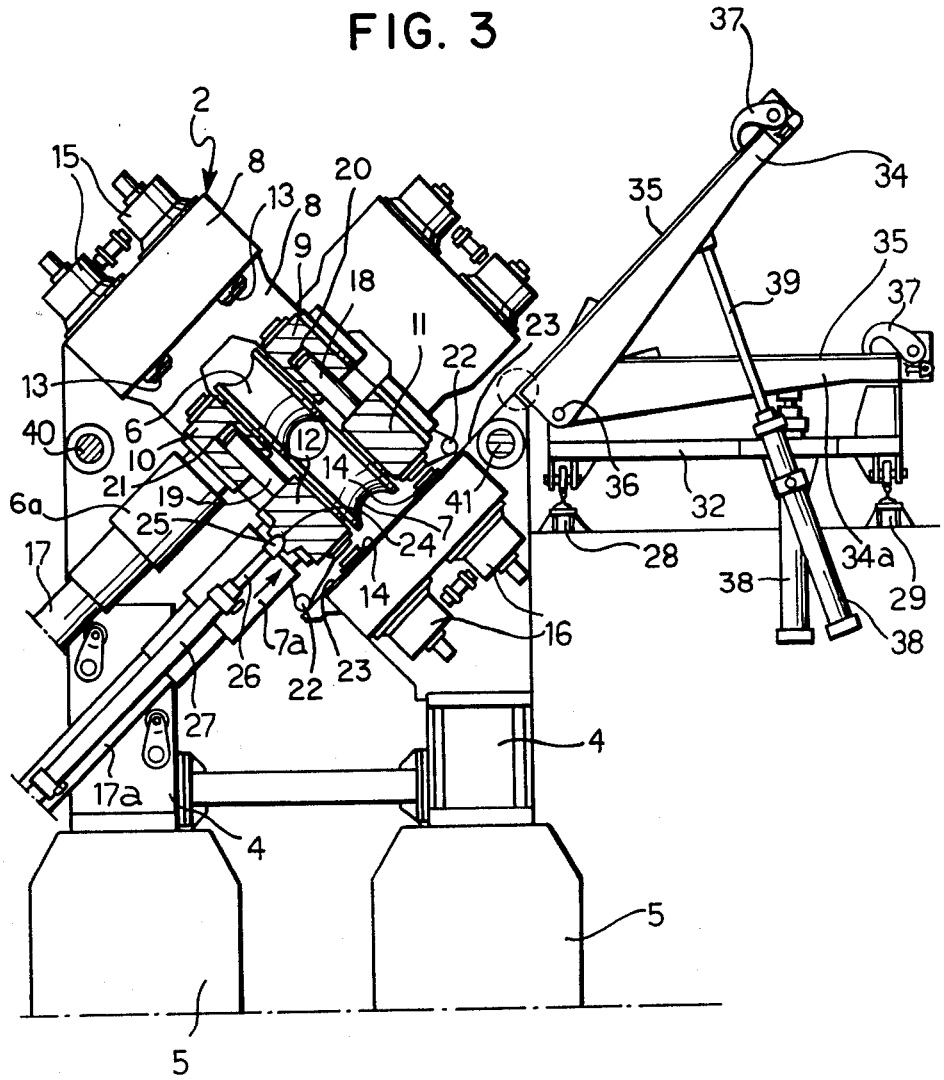
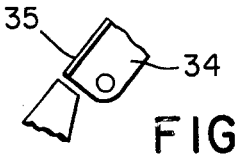
FIG. 3a

CONTINUOUS ROLLING MILL WITH CROSSED STANDS FOR THE PRODUCTION OF SEAMLESS TUBES

BACKGROUND OF THE INVENTION

The invention relates to a continuous rolling mill for the production of seamless tubes starting from hollow intermediate forgings fitted onto respective mandrels.

In particular the invention relates to a continuous rolling mill of the type with crossed stands, that is to say, comprising a plurality of rolling stands inclined alternately to the rolling axis and operating in a so-called retained-mandrel manner.

In continuous rolling mills of the said type, the rolling stands are supported by respective support structures firmly anchored to the ground and generally of excessive size to enable them to withstand safely and effectively the thrusts generated during the rolling process and oriented in directions parallel to the rolling axis.

Each stand of such a rolling mill essentially comprises a pair of working rolls with respective roll chocks, essentially clutch-type members for connecting the working rolls to respective driven shafts, as well as a plurality of mechanical, electrical, hydraulic and/or pneumatic connections and the like, for effecting a whole series of operations, other than rolling, but basically to achieve good operation of the rolling mill.

Among these operations, a particular one which is recognized to be important is the changing of the working rolls of one or more rolling stands simultaneously.

For this operation, until now, the entire stand, including the rolls to be changed, has been replaced by another stand provided with the new working rolls required. For this purpose each stand of a continuous rolling mill of the type under consideration has been designed and formed as a unit which can be manipulated individually and is structurally independent of the other stands so as to allow it to be removed from and inserted into the train of rolls independently of the rest of the stands.

Each stand is releasably fixed in a suitable seat formed in the support structure of the rolling mill by means of locking means and devices the sizes and weight of which can easily be imagined, given the considerable weight of a rolling mill stand of the type under consideration (on average about 20 to about 50 tonnes) and the considerable forces and thrusts in play during the rolling. It is well known that the support structure of a crossed-stand rolling mill, as well as constituting a massive part, also determines the values of the distances between the stands, values which the most up to date rolling technology would wish to reduce to a minimum, if not entirely eliminate.

The changing of the working rolls according to the known art involves a whole series of operations which are complex to carry out as well as requiring considerable and by now, unacceptable periods of time. Indeed the operations of releasing the stands under consideration from the support structure of the rolling mill and of lifting and transferring these stands away from the train of rolls, must always be preceded by a whole series of other operations relating to the disconnection of the hydraulic and/or pneumatic, electrical lines etc. and also the disengagement of the working rolls from their drive shafts. All these operations must then be repeated during the connection of a new stand in the train of rolls.

Thus, when in order to save time, it is required to change several stands simultaneously, there is a further considerable inconvenience, which is the need to use lifting and transfer machines and apparatus of considerable size and power which, in addition to the recognized operating difficulties, involve considerable power consumption, maintenance and deppreciation costs. To this end, account should also be taken of the fact that, in the optimum case, a crossed stand rolling mill of the type under consideration should be provided with two sets of stands of each caliber and, by way of compromise, with two sets of complete stands. The consequent disadvantages of costs and space necessary for such equipment have been recognized for a long time.

The object of the present invention is to provide a crossed-stand continuous rolling mill, particularly for the production of seamless tubes, by the so-called retained-mandrel technique, having structural characteristics whereby changing of the working rolls of one or more of its stands may be effected, while overcoming all the disadvantages mentioned with reference to the known art.

SUMMARY OF THE INVENTION

This problem is resolved by the invention due to the fact that the upper working roll and the lower working roll with their respective upper and lower roll chocks, are mutually fixed together to constitute a unit which can be displaced individually at least in a direction parallel to the axis of rotation of the said rolls and to the fact that it includes means for the guided displacement of the said unit in the said direction from a position in the said rolling stand to a position completely outside the said stand, and vice versa.

According to a second characteristic, a continuous rolling mill according to the invention includes, for each stand at least one movable carriage on rails which extend laterally of and parallel to the said rolling mill, which carriage is provided with a load-carrying platform which can be tipped about an axis parallel to the rolling axis from a horizontal position to an inclined position parallel to the direction of displacement of the said unit, and in that the stand is provided with means for releasably locking the said unit on the said load-carrying platform.

To advantage the means for the guided displacement of the unit constituted by the upper and lower rolls and their roll chocks include a thrust member having a straight line of action parallel to the desired direction of displacement of the said unit and rails fixed in the said stand and for engagement by wheels suitably provided beneath the said unit, similar rails also being provided on the load-carrying platform of the said movable carriage.

In a rolling mill having the structural characteristics specified above, the changing of the rolls of one or more rolling stands may therefore be carried out by the substitution of the unit constituted by the upper and lower working rolls and their roll chocks which are mutually fixed together, by other units with the required characteristics. This substitution may be effected with the simple, single operation of lowering the said unit onto the rails of the stand. The disengagement of the working rolls from their drive shafts (extensions) occurs automatically during the displacement of the said unit towards the load-carrying platform of the corresponding carriage.

Since no displacement of the rolling stands is required, the need to provide and use lifting machines and/or apparatus of considerable power is completely overcome with consequent considerable economic advantages, among which is a considerable saving in energy and an equally considerable saving in time. Moreover, a substantial reduction in size may be achieved, particularly in the length of the bearing and support bed of the stand, and the stands themselves may be fixed or packed, together, for example by means of tie-rods which pass through the plurality of stands placed one against the other, with the consequent elimination of the spaces between one stand and the next. The length of the rolling mill is thus considerably reduced compared with the known art.

BRIEF DESCRIPTION OF THE DRAWINGS

Further characteristics and advantages will become clearer from the description which follows of a continuous crossed-stand rolling mill for the production of seamless tubes according to the invention, made with reference to the appended drawings.

FIGS. 2 and 3 are schematic views in partial cross-section of the continuous rolling mill of FIG. 1 in two different conditions of operation.

FIG. 3*a* is an enlarged fragmentary view of the area within dashed circles in FIGS. 1 and 3.

DETAILED DESCRIPTION OF THE DRAWINGS

Figure 1:
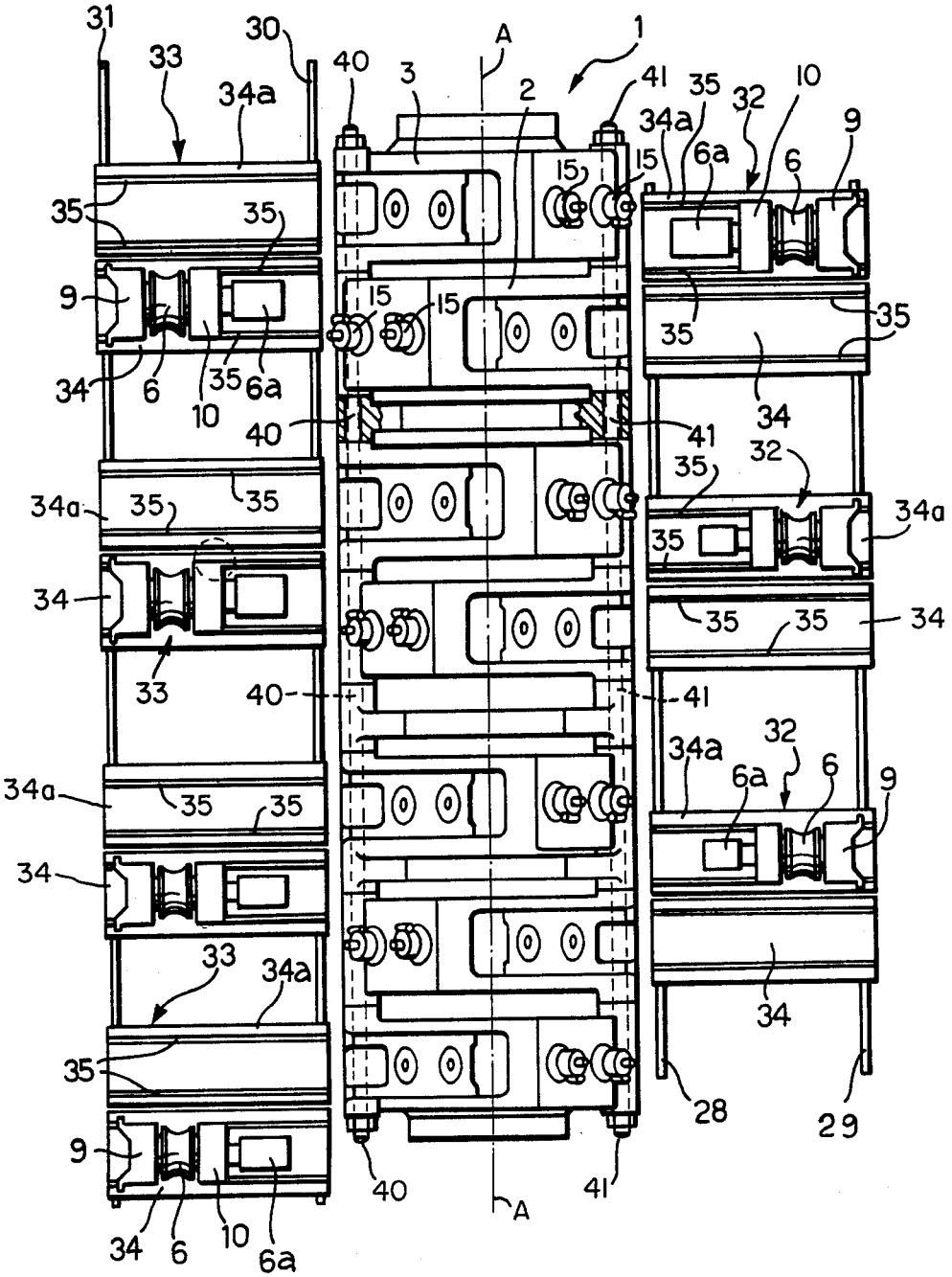
FIG. 1 is a schematic plan view of a continuous crossed-stand rolling mill according to the invention.
Figure 2:
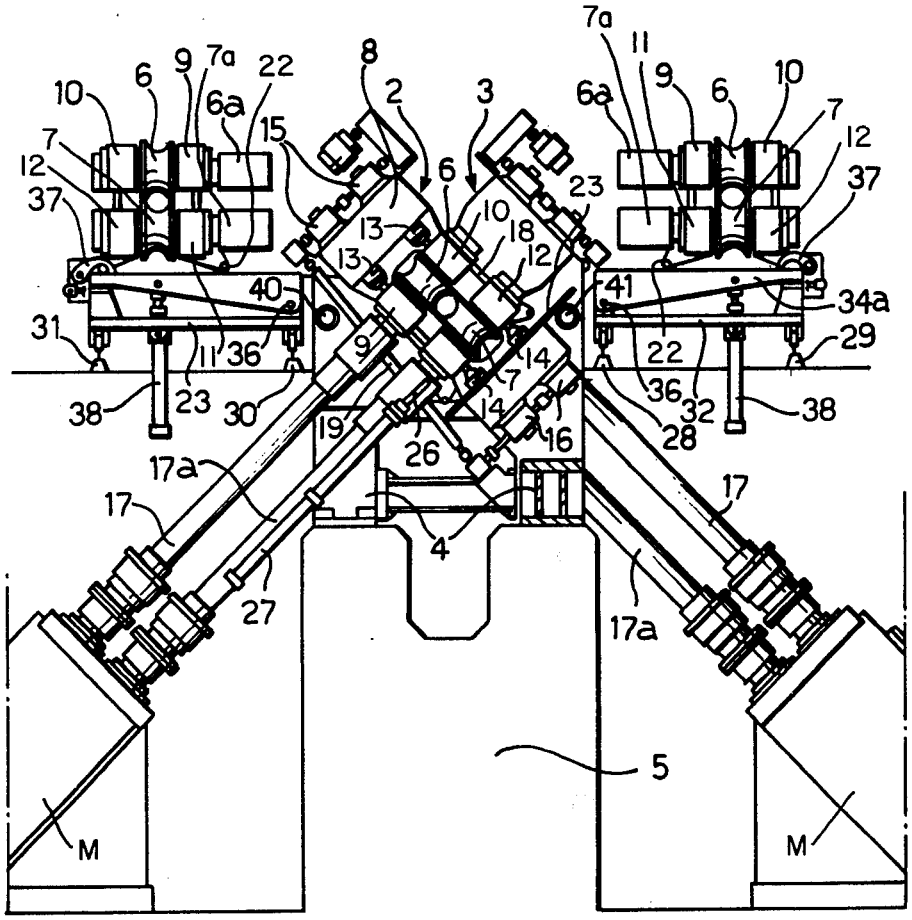

With reference to the said Figures, by 1 is generally indicated a continuous rolling mill for the production of seamless tubes, of the type operating with a retained mandrel and including two series of rolling stands 2, 3, inclined alternately on one side and the other with respect to the rolling axis A.

The entire rolling mill 1 is supported by a structure 4, of suitable dimensions, fixed to foundations 5.

The stands 2, 3, although they may have different sizes, are structurally similar, and only one of these will be described below.

Each rolling stand includes two working rolls, an upper roll 6 and a lower roll 7, rotatably supported by a structure 8 with the interposition of roll chocks, including clutch members, bearings, and service connections, indicated generally as blocks 9–10 and 11–12 respectively. The structure 8 also supports conventional devices for adjusting and positioning the working rolls 6, 7. In the appended drawings, the said devices are exemplified by pairs of screws, upper ones 13, and lower ones 14 actuated by respective reduction gears, driven by motors 15, 16 and acting on the roll chocks 9–10 and 11–12 mentioned above.

A geared motor unit, shown schematically at M, drives the rotation of the working rolls 6, 7 through respective drive shafts or extensions 17, 17*a*. In particular, the working rolls 6, 7 are connectible to the said extensions 17, 17*a* through rapid engagement clutch members, schematically shown at 6*a*, 7*a*, of the type with straight, axial teeth.

In each rolling stand, the assembly comprising the upper working roll 6 with its roll chocks 9–10 and the lower working roll 7 with its roll chocks 11–12, constitutes a unit which is individually displaceable in a direction parallel to the axis of rotation of the aforesaid working rolls, although the possibility of varying the spacing between these rolls (roll aperture) remains unchanged.

For this purpose, and in accordance with a preferred embodiment, the roll chocks 11–12 of the lower working roll 7 are provided with uprights 18, 19 projecting in a direction perpendicular to the rolling axis A and to the axis of the roll 7. These uprights 18, 19 are slidably engaged in corresponding seats 20, 21 included in the roll chocks 9–10 of the upper working roll 6.

The under sides of the roll chocks 11–12 are further provided with a pair of wheels 22, 22 intended to engage rails 23 fixed in each stand and extending parallel to the axes of the working rolls 6, 7 when mounted in the said stand.

In the wall of the ancillary block 11 facing outwardly of the rolling stand there is formed an essentially hemispherical recess 24 of such a size that it can releasably engage the rounded head 25 of a shaft 26 driven by a double-acting hydraulic cylinder 27. The straight line of action of this hydraulic cylinder 27 is parallel to the axes of the rolls 6, 7 when positioned in the stand 2 and hence parallel to the rails 23 of the said stand.

On the two sides of the rolling mill 1 parallel to the rolling axis A are provided rails 28–29 and 30–31 on which two series of carriages 32–33 (one carriage for each stand) are movable and on which are provided conventional means and devices for releasably locking a carriage in correspondence with the respective stand Each of the said carriages 32–33 is provided with two load-carrying platforms 34–34*a* provided with rails 35, extending perpendicular to the rolling axis A and which can be tipped about a pivot axis, 36 parallel to the said axis A, from a horizontal position to an inclined position in which their rails 35 extend as elongations of the rails 23 of the respective rolling stand. Each load-carrying platform 34, 34*a* is so dimensioned and formed as to couple completely with one of the said units constituted by a pair of working rolls and its associated roll chocks and is provided on its opposite side to that opposite the pivot axis 36 with a plurality of essentially hook-shaped members 37 hydraulically actuated and intended to releasably engage and retain one of the said units on the said loading platform.

By 38 is schematically shown a double-acting hydraulic cylinder carried by each carriage in correspondence with each platform and having the free end of the respective shaft 39 pivoted to the platform 34 for the angular displacement thereof about the axis 36.

When it is required to change the working rolls of one or more of the rolling stands in the rolling mill described above, it is no longer necessary to replace the entire stand, but more simply and rapidly, to replace solely the individually displaceable unit which is constituted by the working rolls under consideration and their roll chocks.

In order to carry out such an operation, this is effected as follows.

Initially each carriage 32–33 is halted and locked in correspondence with a stand and the free loading platform 34*a* thereof is brought into the inclined position in which the respective rails 35 are aligned with the rails of the said stand. Subsequently or even simultaneously, by the action of the screws 13, 14 the assembly constituted by the working rolls 6, 7 and their roll chocks is brought into the lowered position until the wheels 22 of the lower roll chock engage the rails 23 of the stand. At this point, through the action of the hydraulic cylinder 27, the said unit (working rolls 6 and 7 and respective roll chocks 9–10 and 11–12) is thrust out of the stand towards and onto the platform 34*a* mentioned above. When the said unit has reached a predetermined position on the platform 34*a* , the hooks 37 of the said platform are actuated hydraulically so as to engage the roll chock of the lower roll and retain the unit firmly on tne platform itself. Only at this moment is the hydraulic cylinder 27 again actuated to disengage the head 25 of the shaft 26 from the corresponding recess 24.

Through the action of the hydraulic cylinder 38, the platform 34*a* and its load are brought into the horizontal position and the carriage 32 may be moved a certain distance whereby the position previously occupied by the platform 34*a* becomes occupied by the other platform 34 of this carriage. On this platform there has previously been fixed a new pair of working rolls and respective roll chocks retained by the respective hook members 37. This platform and its load is now brought into the inclined position and the steps described above are repeated in the inverse sequence. Consequently the new pair of working rolls and their roll chocks are inserted in the stand which is then brought back to its operative condition by the actuation of the screws 13, 14.

At this point it is important to note that the correct positioning of the rolls, once inserted in the working stand, is ensured by the adjusting screws, the movement of which is controlled by suitable and well known position transducers. Thus errors due to play and to wear of the drive chains for the screws themselves are eliminated.

The only check which must be made on the ground on the roll chocks before their assembly is the verification and possible registration by means of spacers of the wear of the safety devices, and bronze thrust bearings facing the screws.

The alignment is thus ensured without recourse to particular or special procedures and/or devices. Since the changing of the working rolls is effected without any displacement of any of the rolling stands which constitute a rolling mill according to the invention, the said rolling stands may be mutually fixed together in a direction parallel to the axis A by means, for example, of a pair of tie rods 40–41, of suitable sizes and locked by conventional devices to the outer walls of the end stands of the rolling mill. This being done, the plurality of rolling stands may be considered as a monolithic entity against thrusts and forces parallel to the rolling axis A and generated during the operation of the rolling mill. There is thus overcome the present need to design, make and put into operation a suitable support structure for each rolling stand and for the combination of these, resulting in a substantial reduction in the weight on the foundations, a reduction in the spaces between adjacent stands and, hence in the entire length of the rolling mill. Furthermore, the absence of such a support structure considerably improves the accessibility of the environment around the rolling mill, facilitating the cleaning and maintanence operations considerably, as well as the removal of mill scale.

We claim:

1. A continuous rolling mill of the crossed stand type for the production of seamless tubes comprising: a plurality of successive rolling stands inclined alternately to the rolling axis, in which each stand includes an upper working roll, a lower working roll and respective roll chocks for said rolls which together form a unit; means for displacing each said unit individually at least in a direction parallel to the axes of rotation of the rolls; means for the guided displacement of the said unit in the said direction between its position within the rolling stand and a position completely outside the stand; rails extending parallel to the rolling direciton at the sides of the rolling mill; at least one carriage for each said unit movable on said rails and provided with a load-carrying platform which can be tipped about a horizontal axis parallel to the rolling axis from a horizontal position to an inclined position parallel to the direction of displacement of the said unit into and out from the stand; and means for the releasable locking of the said unit on said load-carrying platform.

2. A rolling mill as difined in claim 1, wherein each unit is provided with wheels in a lower part; said means for the guided displacement of the said unit include a thrust member having a straight line of action parallel to the desired direction of displacement of the said unit; rails fixed in the said stand for engagement by said wheels with which the unit is provided; and similar rails on the said load-carrying platform of the movable carriage for receiving the unit.

3. Rolling mill as defined in claim 1 or claim 2, characterized in that each carriage is provided with two similar load-carrying platforms angularly tippable about a common axis parallel to the rolling axis and intended respectively to couple with and transport one of the said units constituted by working rolls and their respective roll chocks.

4. A continuous rolling mill for the production of seamless tubes comprising:

(a) a plurality of successive rolling stands inclined alternately to a rolling axis;

(b) upper and lower working rolls with respective upper and lower roll chocks in each of said rolling stands, said lower roll chocks being provided with respective uprights perpendicular to the rolling axis and to the axis of the respective lower working roll, said uprights being slidably engaged in corresponding seats provided in the upper roll chocks, whereby the upper and lower working rolls and respective roll chocks are displaceable as a unit and out of said rolling stand in a direction parallel to the axis of the working rolls;

(c) rails extending parallel to said rolling axis at the sides of said plurality of rolling stands;

(d) a plurality of independent carriages movable on each of said rails, each carriage being provided with a load-carrying platform which can be tipped about a horizontal axis parallel to the rolling axis from a horizontal position to an inclinded position parallel to the direction of the displacement of said unit;

(e) means for releasably locking said unit on said load-carrying platform; and (f) means for guiding displacement of said unit along said rails between a postion within said stand and a position on said load-carrying platform when said platform is in an inclined position.

5. A rolling milling according to claim 4, wherein said means for the guided displacement of said unit include a thrust member having a straight line of action parallel to the desired direction of displacement of the said unit, rails fixed in said stand for engagement by said unit, and corresponding rails on the load-carrying platform of a movable carriage for receiving the unit.

6. A rolling mill according to claim 4, wherein each carriage includes two similar load-carrying platforms angularly tippable about a common axis parallel to the rolling axis and intended respectively to couple with and transport one of said units having working rolls and their respective roll chocks.

7. A rolling mill according to claim 4, wherein the plurality of inclined stands are mutually fixed together by means of at least two tie-rods so as to constitute a monolithic entity.

* * * * *

UNITED STATES PATENT AND TRADEMARK OFFICE

CERTIFICATE OF CORRECTION

PATENT NO. : 4,478,065

DATED : October 23, 1984

INVENTOR(S) : Emanuele Gancia et al

It is certified that error appears in the above-identified patent and that said Letters Patent is hereby corrected as shown below:

The title page should be deleted to appear as per attached title page.

Signed and Sealed this

*Eighteenth* Day of *June 1985*

[SEAL]

*Attest:*

DONALD J. QUIGG

*Attesting Officer*

*Acting Commissioner of Patents and Trademarks*

United States Patent [19]

Gancia et al.

[11] Patent Number: 4,478,065

[45] Date of Patent: Oct. 23, 1984

[54] CONTINUOUS ROLLING MILL WITH CROSSED STANDS FOR THE PRODUCTION OF SEAMLESS TUBES

[75] Inventors: Emanuele Gancia, Pioltello; Cesare Galletti, S. Felice di Segrate, both of Italy

[73] Assignee: Innse Innocenti Santeustacchio S.p.A., Brescia, Italy

[21] Appl. No.: 387,256

[22] Filed: Jun. 10, 1982

[30] Foreign Application Priority Data

Jun. 11, 1981 [IT] Italy ..... 22255 A/81

[51] Int. Cl.[3] ..... B21B 31/08

[52] U.S. Cl. ..... 72/239

[58] Field of Search ..... 72/235, 238, 239, 481, 72/482, 446, 448; 100/918

[56] References Cited

U.S. PATENT DOCUMENTS 4,406,145 9/1983 Akita ..... 72/239

FOREIGN PATENT DOCUMENTS 53-60861 5/1978 Japan ..... 72/238

*Primary Examiner*—E. Michael Combs
*Assistant Examiner*—Charles Rosenberg
*Attorney, Agent, or Firm*—Fleit, Jacobson, Cohn & Price

[57] ABSTRACT

A continuous rolling mill with crossed alternately inclined stands is described in which the working rolls and their roll chocks forming each stand are united to form a unit which can be displaced individually in a direction parallel to the axes of rotation of the said rolls. During changing of the rolls, a thrust member expels the said unit from the stand, in a direction parallel to the axes of rotation of the rolls, onto a load-carrying platform which can be tipped about an axis parallel to the rolling direction to a horizontal position on a carriage which is movable on rails along the sides of the rolling mill.

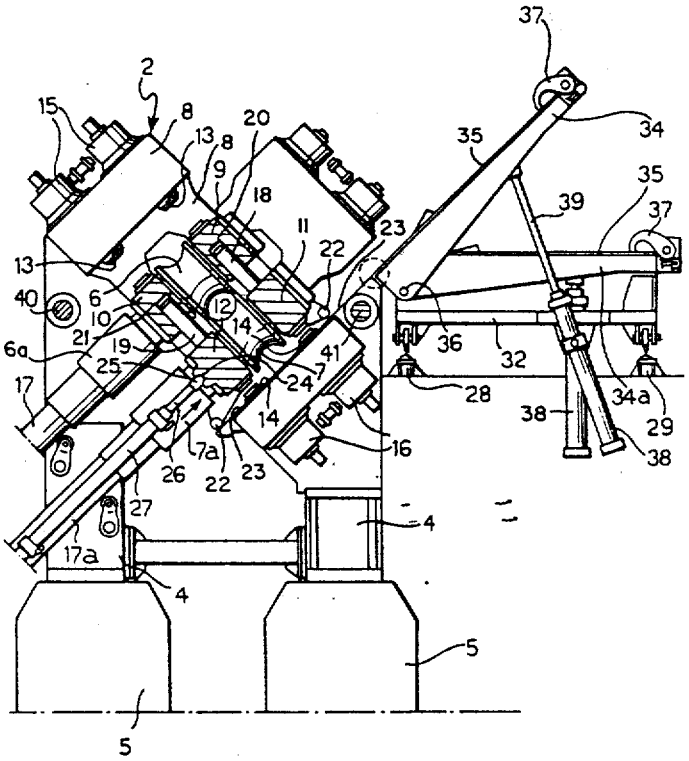

7 Claims, 4 Drawing Figures